US005337967A

United States Patent [19]

Teich et al.

[11] Patent Number: 5,337,967

[45] Date of Patent: Aug. 16, 1994

[54] TEXTILE YARN PROCESSING APPARATUS

[75] Inventors: Udo Teich, Sprockhövel; Ludger A. Deters, Remscheid, both of Fed. Rep. of Germany

[73] Assignee: Barmag AG, Remscheid, Fed. Rep. of Germany

[21] Appl. No.: 962,884

[22] Filed: Oct. 19, 1992

[30] Foreign Application Priority Data

Oct. 18, 1991 [DE] Fed. Rep. of Germany ..... 4134453

[51] Int. Cl.[5] ..... B65H 67/06

[52] U.S. Cl. ..... 242/35.5 A

[58] Field of Search ..... 242/35.5 A, 35.5 R; 414/331

[56] References Cited

U.S. PATENT DOCUMENTS

| | | | |
|---|---|---|---|
| Re. 31,839 | 2/1985 | Schippers et al. | 242/35.5 A |
| 3,987,974 | 10/1976 | Mayer | 242/35.5 A |
| 3,995,725 | 12/1976 | Howell, Jr. | 104/200 |
| 4,023,743 | 5/1977 | Schippers | 242/35.5 A |
| 4,340,187 | 7/1982 | Schippers et al. | 242/35.5 A |
| 4,351,494 | 9/1982 | Schippers et al. | 242/35.5 A |
| 4,515,328 | 5/1985 | Payne, Jr. | 242/35.5 A |
| 4,621,778 | 11/1986 | Paravella et al. | 242/35.5 A |
| 4,998,857 | 3/1991 | Paravella et al. | 414/331 |

FOREIGN PATENT DOCUMENTS

| | | |
|---|---|---|
| 0478164 | 4/1992 | European Pat. Off. . |
| 0486039 | 5/1992 | European Pat. Off. . |
| 4013066 | 10/1990 | Fed. Rep. of Germany . |
| 1399891 | 7/1975 | United Kingdom . |
| 2236768A | 4/1991 | United Kingdom . |

OTHER PUBLICATIONS

"Melliand Textilberichte", Jul. 1985, pp. 499-503.

*Primary Examiner*—Stanley N. Gilreath

*Attorney, Agent, or Firm*—Bell, Seltzer, Park & Gibson

[57] ABSTRACT

A textile yarn spinning apparatus for the continuous production of a plurality of synthetic filament yarns is described, which comprises a plurality of winding machines arranged in rows along a service aisle, and a doffer adapted for movement in the service aisle from winding machine to winding machine. The doffer receives at each contacted and serviced winding machine full packages from the winding spindles and delivers the full packages to a transport carriage. In addition to the doffer, a back-up system is provided for manually removing full packages from the winding spindles, and which comprises an independent service carriage for loading the full packages, and an elevator for lifting the full packages so that they can be transferred to the mandrels on a transport carriage.

13 Claims, 2 Drawing Sheets

TEXTILE YARN PROCESSING APPARATUS

CROSS REFERENCE TO RELATED APPLICATIONS

This application contains subject matter related to the subject matter of application Ser. No. 07/945,111; application Ser. No. 07/945,114; and application Ser. No. 07/945,115, all filed on Sep. 14, 1992.

BACKGROUND OF THE INVENTION

The present invention relates to a textile yarn processing apparatus, such as a spinning plant, for the continuous production of a plurality of synthetic filament yarns.

DE OS 29 39 675 and corresponding U.S. Pat. No. 4,340,187 disclose a package doffing device for such a spinning installation, in which a yarn servicing carriage moves in the service aisle from one winding machine to another. The yarn servicing carriage is operatively linked with a package doffing carriage. To do so, at each contacted and serviced winding machine, the full packages are removed from the winding spindle and transferred to the package doffing carriage, which then delivers the packages to a package transport device. The package transport device receives a plurality of packages, which it then transports to a control station for the individual packages. Thereafter, the full packages having been found to be satisfactory, advance to a packing station.

The above described installation is subject to a rigid time sequence in the production of full packages, since ultimately the time intervals necessary for refilling the package transport devices determine the production speed. A lengthening of the time intervals can be realized only by enlarging the package transport devices or by increasing their number. However, in view of the number of full packages to be received, limits are set to the first of the two measures due the high package weights which are presently being produced, since otherwise it would no longer be possible to handle the package transport devices. The second of the two measures necessitates an increased floor space requirement.

As used in the present application, a doffer is understood to be an apparatus traveling along a machine front from winding machine to winding machine, which doffs the produced full packages at the end of a winding cycle. This doffing operation includes the removal of full packages from each serviced winding spindle and the transfer of these full packages to a transport carriage for further transportation.

The time of removing the produced full packages is monitored by the doffer, it being useful that the doffer also requests the respectively needed number of empty tubes.

In one embodiment, the doffer is additionally designed to furnish the just-serviced winding spindle with new empty tubes after removing and transferring the full packages, so that the takeup machine is able to continue its winding operation. Such a doffer is known, for example, from DE AS 24 49 415. In the case of this doffer, the required number of needed empty tubes is continuously furnished by means of a conveyor chain passing by the doffer.

Also known from DE OS 21 28 974, is a package doffing carriage which replaces full packages with empty tubes. In this embodiment, the empty tubes are carried along on the package doffing carriage and transferred to the winding spindle of the takeup machine by means of two gripping arms.

DE OS 21 23 689 also discloses a traveling package doffer, which delivers the full packages to a traveling package transport device. Subsequently, the package transport device is moved to a control station, where the individual full packages are subjected either individually or randomly to a quality check, and then continue to a packing station.

In light of this prior art, it is the object of the present invention to improve a yarn processing apparatus, such as a spinning plant for the uninterrupted production of a plurality of synthetic filament yarns, so that it becomes independent of possible breakdowns in the fully automatic doffer system.

It is another object of the invention to provide such an apparatus with a small floor space requirement.

SUMMARY OF THE INVENTION

The above and other objects and advantages of the present invention are achieved in the embodiments illustrated herein by the provision of a textile yarn processing apparatus which comprises a plurality of yarn winding machines arranged in parallel rows to define a service aisle therebetween, with each of the winding machines having at least one winding spindle positioned at a predetermined first elevation and which is adapted to have at least one yarn package wound thereon. A package doffer is adapted to move along the service aisle of the winding machines for receiving full packages from the winding spindles at the first elevation and lifting the same to a predetermined second elevation, a transport carriage is movable along a path of travel which includes the service aisle and includes at least one transport mandrel positioned at the second elevation, and such that the transport mandrel is adapted to receive full packages from the doffer at the second elevation. Also, an independent service carriage is provided which is configured for movement along the service aisle and which has at least one carriage mandrel mounted at the first elevation and so as to be adapted to receive full packages from each of the winding spindles at the first elevation. An emergency elevator is also provided which includes a lifting mandrel mounted for vertical movement between the first and second elevations, and the elevator is located at a fixed location adjacent the path of travel of the carriage, such that the service carriage may be used to transport full packages from the winding mandrels of the winding machines to the lifting mandrel at the first elevation and the full packages may then be lifted to the second elevation and transferred to the transport mandrel of the carriage.

The invention as defined above provides the advantage that the spinning plant is able to continue its fully automatic production even when the fully automatic doffer system fails.

The apparatus of the invention typically comprises a plurality of the individually movable transport carriages, which are adapted to travel independently of each other, and which form a transport system which is always available to service the winding spindles. This results in a flexible servicing in accordance with the respective need of the individual winding spindles of the winding machines. The waiting times for doffing full packages at the end of a winding cycle are therefore minimized. Consequently, it is possible to achieve a high degree of utilization for the winding machines. Furthermore, the individually movable transport carriages permit a removal of full packages at any time.

The positioning of the transport carriages at an elevation above the winding spindles provides the advantage that a space-saving arrangement of the rows of winding machines is possible, and it is nonetheless possible to utilize the advantages of the invention. Depending on the available floor space, it is possible to arrange the several service aisles of the individual rows of winding machines in a parallel, perpendicular, or star-shaped relationship. The conveying tracks in the individual service aisles extend at heights which are substantially identical and predetermined by the working heights of the doffers.

The independent service carriage of the present invention is adapted for movement entirely independently of the transport carriages and the doffer, so that it is always immediately available in the case of need. Also, the independent service carriage is provided with rigid mandrels for the packages, which are fixedly mounted on the service carriage at the elevation of the winding spindles of the winding machines.

The emergency elevator serves to lift the full packages onto one of the transport carriages, and it moves upward in its loaded condition and downward in its unloaded condition. In so doing, the elevator moves between the height of the winding spindles and the height of the transport mandrels on the transport carriage.

The transport carriages are loaded in a loading position adjacent the emergency elevator. To this end, it is necessary that the conveyor track of the transport carriages passes by this loading position.

In the preferred embodiment, the independent service carriage is not provided with separate drive means and it is movable manually, which simplifies its construction. Also, the service carriage is guided for movement along a rail which extends along the service aisle of the winding machines. This ensures that the service carriage can be brought to its loading position without complicated driving maneuvers. By design, the proper positioning of the service carriage occurs along the path established by the rail.

The conveying track for the transport carriages preferably has a return track segment which passes an empty tube magazine, so that each transport carriage can be loaded with empty tubes. The elevator may then receive the empty tubes from the transport carriages and transfer them to the independent service carriage for delivery to the winding spindles of the winding machines. This feature utilizes the knowledge that after having delivered the full packages, for example, to a stationary or movable temporary storage, the transport carriages have a renewed loading capacity. In this simple manner, it is possible to accomplish that new empty tubes are immediately available for a package doff of the respectively serviced winding machine. Another advantage is the fact that it is possible to provide empty tubes originating from a certain empty tube magazine with markings, so as to be able to use this information, if need be, in the quality control as well as in the product follow-up. In this respect, the emergency elevator is able to assume a double function.

The conveying track of the transport carriages is preferably designed as an overhead system, which offers the further advantage that the floor space of the service aisle between the row of winding machines remains unoccupied and is free to permit movement by service personnel.

The winding spindle of each winding machine preferably receives an even number of winding tubes, and a pair of mandrels are provided on the service carriage. Likewise, a pair of mandrels is provided on the elevator and on the transport carriages, and each mandrel of each pair is designed to receive one half the number of packages from a single winding spindle. Also, the pairs of mandrels are uniformly spaced from each other in a horizontal direction to facilitate transport therebetween. These measures permit the spacings of the service aisles between the rows of winding machines to be very small. During transportation, the mandrels of the transport carriages project horizontally into the service aisle so that they each point in the direction of the winding machine front. The paired arrangement of the transport mandrels ensures that the projecting length can be halved. As a result, it is possible to move the rows of winding machines closer together, so that less floor space is needed. Due to this arrangement, a clear association of the produced full packages to the respective winding machine remains intact with the least floor space requirement. Furthermore, this simple measure allows the service carriages to be designed with a lightweight construction, since the risk of tipping due to overweight is reduced.

The emergency elevator is preferably positioned at a fixed location adjacent one end of the service aisle, and so as to enable an unobstructed operation of the other transport carriages, when the emergency elevator loads one of the transport carriages with full packages or respectively unloads therefrom empty tubes.

BRIEF DESCRIPTION OF THE DRAWINGS

Some of the objects and advantages of the present invention having been stated, others will appear as the description proceeds, when taken in conjunction with the accompanying drawings, in which.

BRIEF DESCRIPTION OF THE PREFERRED EMBODIMENTS

Figure 1:
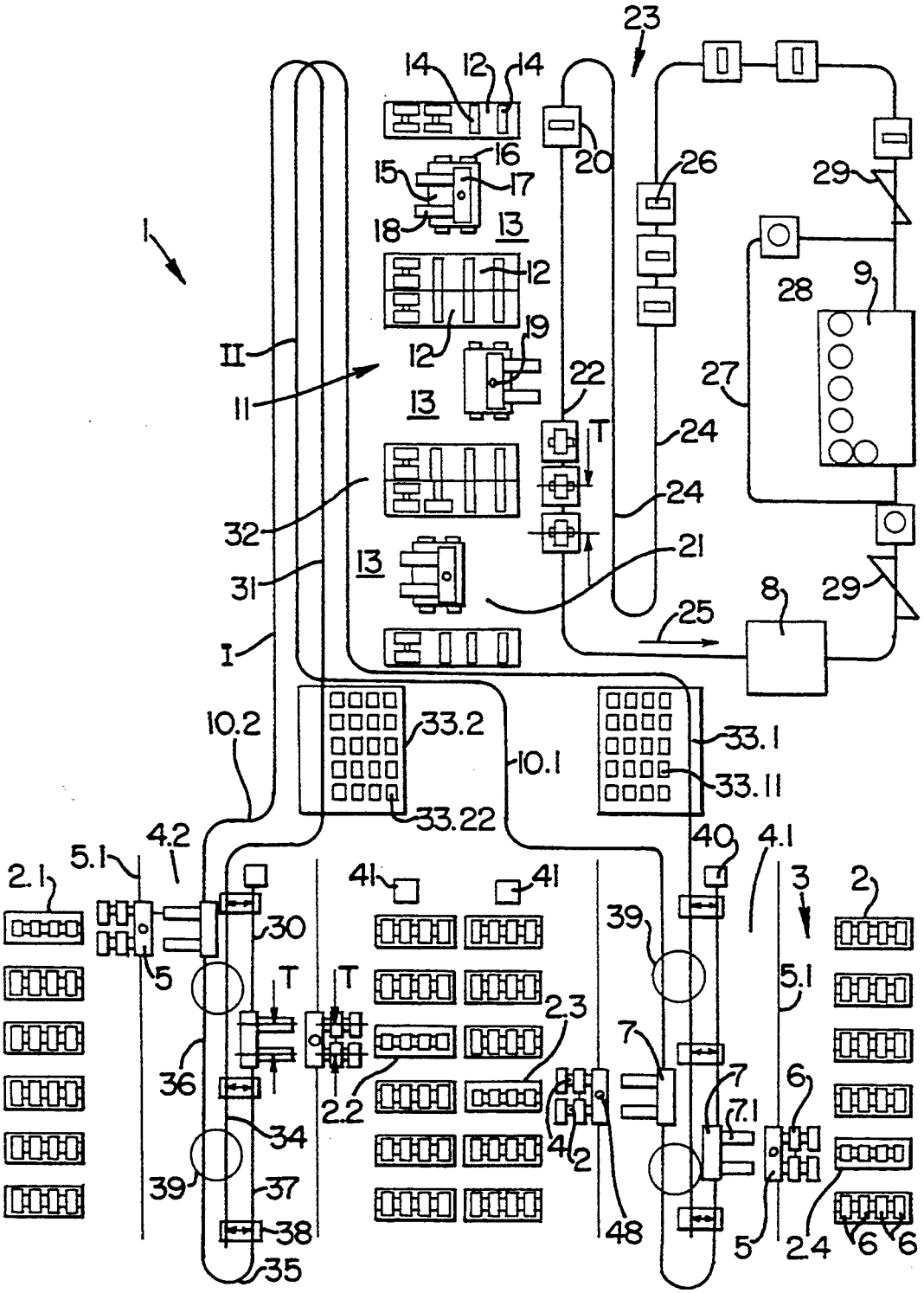
FIG. 1 is a schematic top plan view of a textile yarn spinning plant in accordance with the present invention.

Referring more particularly to the drawings, FIG. 1 schematically illustrates a spinning apparatus 1 in accordance with the present invention, and which is adapted for an uninterrupted production of a plurality of synthetic filament yarns. The apparatus comprises a plurality of winding machines 2 which are arranged in rows 3 of winding machines along a service aisle 4.1, 4.2. Illustrated in the FIGURE are two service aisles 4.1, 4.2 which are aligned parallel to one another. On each side of each of the service aisles, respectively one row 3 of winding machines 2 is arranged parallel to service aisle 4.1, 4.2, with the winding spindles of the individual winding machines projecting perpendicularly into the service aisle.

In each of the service aisles, a doffer 5 is provided which travels along a track 5.1 such that the doffer 5 is able to move along track 5.1 from winding machine to winding machine. In the illustrated embodiment, a separate doffer 5 is associated to each row of winding machines. However, it should be noted that it is also possible to have a single doffer travel along one doffer track in each service aisle, which passes by both columns of winding machines.

At each contacted and serviced winding machine 2.1, 2.2, 2.3, 2.4, the doffer receives full packages 6 from the winding spindle and delivers same to a transport carriage 7, which is for this purpose on standby at each contacted and serviced winding machine 2.1, 2.2, 2.3, 2.4, so as to take over the full packages. The full packages are transferred to the transport carriage by means of a mandrel 7.1, as will be described in more detail below.

Associated to each of the service aisles 4.1, 4.2 is a conveying track 10.1, 10.2. A plurality of individually movable transport carriages 7 travel along each of the conveying tracks, with each individual transport carriage having its separate drive, and being adapted to stop independently of the other transport carriages.

The conveying tracks extend between the front sides of the winding machine rows and a temporary package storage 11 such that the transport carriages can travel forward and back along this path free of impediments.

To this end, each of the individual conveying tracks is designed as a closed loop, and comprises a forward track segment 30 from the service aisle 4.1, 4.2 to the temporary storage 11, and a return track segment 31 in the reverse direction, with one closed-loop track respectively extending in service aisle 4.1, 4.2, and thence to one of the front ends 32 of the storage aisles 13 of the temporary storage 11.

As used in the present application, the forward track segment 30 may be defined as the portion of each conveying track which the transport carriages traverse when loaded with full packages from a winding spindle and until the full packages are transferred to the temporary storage 11.

One characteristic to be noted is that the return segment 31 of each conveying track 10.1, 10.2 passes by an empty tube magazine 33.1, 33.2 respectively, where the mandrels 7.1 of the transport carriages 7 receive the empty tubes 33.11, 33.22 which are required by a winding spindle.

Another characteristic is that, as shown in FIG. 1, the return segment 31 of each of the closed-loop conveying tracks 10.1, 10.2 extends in the form of a cul-de-sac 34 along service aisle 4.1, 4.2, and that the forward segment 30 has a U-shape in the service aisle, with a first branch 36 leading to temporary storage 11 extending along one of the two sides of the return track segment 31, and with a second branch 37 terminating at the end of service aisle 4.1, 4.2 which is proximate to the temporary storage 11, and extending on the other side of return track 31. At the end remote from the temporary storage 11, the first branch 36 and the second branch 37 are interconnected by a reversing loop 35, and the branches 36 and 37 are connected with the return track segment 31 by means of switches.

To this end, the return track segment 31 is connected with the first branch 36 of forward track segment 30 by means of turning switches 39 which redirect the transport carriages 7 coming from the return track segment 31 onto the first branch 36 of forward track segment 30 while reversing the traveling direction. Further, the return track segment 31 is connected with the second branch 37 of forward track segment 30 by means of parallel switches 38 which redirect the transport carriage 7 advancing from the return track segment 31 onto the second branch 37 while maintaining the traveling directions.

When viewed in the traveling direction of the return track segment 31, a total of five switches are successively arranged, with turning switches and parallel switches alternating one another. Furthermore, the turning and parallel switches are arranged in close vicinity.

Such an arrangement of switches ensures that each of the transport carriages 7 needs not always travel along the entire U-shaped path, when it is necessary to service one of the winding machines. Further, it is ensured that each of the transport carriages arrives on any possible track at a doffer always such that its projecting mandrels face the doffer in the correct receiving position.

The conveying tracks respectively associated to the service aisles are independent of one another, in that the conveying tracks 10.1, 10.2 extend in different heights I, II along the temporary storage. The conveying heights I, II are spaced from one another at such a large vertical distance that the individual transport carriages of the two conveying tracks are unable to contact each other.

The full packages received by the transport carriages are to be moved to a package processing area which includes a control station 8 for the individual packages, and then a packing station 9. Since the full packages are continuously produced on the winding machines, all transport carriages are employed in a twenty-four hour operation, and in accordance with the present invention, the full packages are conveyed from the winding machines to the stationary temporary storage 11 before proceeding to the package processing area.

The temporary storage 11 comprises several high-rise creels 12 which are arranged parallel to one another, and each pair of which forms a storage aisle 13 therebetween. Each of the high-rise creels is provided with a plurality of storage mandrels 14.

As one can visualize, the storage mandrels 14 are juxtaposed and superposed in tiers, and project in the direction of storage aisle 13, note also FIG. 1. In each of the storage aisles, a servicing device 15 is provided for forward and backward movement between both ends 21 and 32 of the storage aisle.

Each servicing device 15 is provided with a bottom platform which is equipped with wheels 16, and carries an elevator 17 with a pair of transport mandrels 18. The latter serve to receive the full packages delivered by a transport carriage 7 and to transfer same to storage mandrels 14 of one of the high-rise creels, as well as to receive full packages of a winding spindle and to transfer same to individual conveyor platforms 20, as will be described in more detail below. In any event, it is a special embodiment of the invention to provide for a paired arrangement of the mandrels.

The pair of mandrels 18 on each servicing device 15 can be moved up and down by means of the elevator 17, the latter being rotatable about a vertical axis 19 such that a mandrel 18 of the servicing device 15 may be aligned with either a mandrel 7.1 of the transport carriage 7 or with a storage mandrel 14.

In another embodiment, which is not illustrated in the drawings, the service device 15 may be bipartite. A first part is movable along the storage aisle 13, and a second part is stationarily arranged respectively in front of the storage aisle. The stationary part is adapted for upward and downward movement between conveying heights I, II of the conveying tracks 10.1, 10.2, and is also rotatable by 180°. As a result, the delivered full packages are first received by the stationary part, and subsequently delivered to the movable part for temporary storage.

The individual conveyor platforms 20 transport the temporarily stored full packages during the shift operation of the control station 8 and the packing station 9. To this end, the individual conveyor platforms are adapted for movement between a receiving area adjacent one of the ends 21 of storage aisles 13 and control station 8 as well as packing station 9.

In the present embodiment, this occurs on a peripheral conveyor track 22, which includes a buffer storage track 23 extending in the form of parallel bypass loops 24 between the packing station 9 and the end 21 of storage aisles 13. As illustrated, the peripheral conveyor track 22 includes an article tilting section 29 immediately upstream of the packaging station 9 and a second tilting section immediately downstream of the packaging station 9, for rotating the conveyor platforms 20 by 90°, and as further described in copending application Ser. No. 07/945,115. Also, the conveyor track 22 may include a track section 27 which bypasses the packing station 9 to return packages 28 which are determined to be of inferior quality.

Each individual conveyor platform 20 travels along this transport track in direction 25, and each individual conveyor platform 20 is adapted for movement to a stopped position in the receiving area adjacent the end 21 of storage aisles 13, in which the full packages are transferred by means of the servicing device 15.

To transfer the full packages, each individual conveyor platform 10 includes a mandrel 26 which points in each of the stopped positions with its free end horizontally into the storage aisle. In the intermediate of the three storage aisles, the elevator is pivoted in such a manner and moved to such a height that two transport mandrels 26 of two adjacent individual conveyor platforms 20 can be simultaneously serviced by the two mandrels 18 of the elevator, as will be described in more detail below.

In accordance with the present invention, an elevator 40 and an emergency service carriage 41 are provided for each of the service aisles 4.1, 4.2. The elevator 40 allows packages to be lifted which in an emergency have been loaded by hand on the emergency service carriage 41, to the level of the transport carriage 7.

In the illustrated preferred embodiment, the emergency elevator 40 is arranged at the end of the second branch 37 of the forward track segment 30, so that the emergency elevator 40 is unable to interfere with the continuous operation of the transport carriages 7.

Figure 2A:
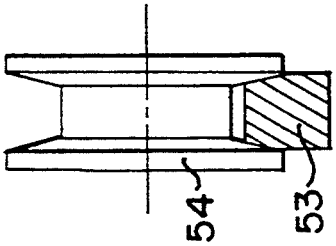
FIG. 2A is an enlarged fragmentary view of the portion of FIG. 2 indicated by the circle A.
Figure 2:
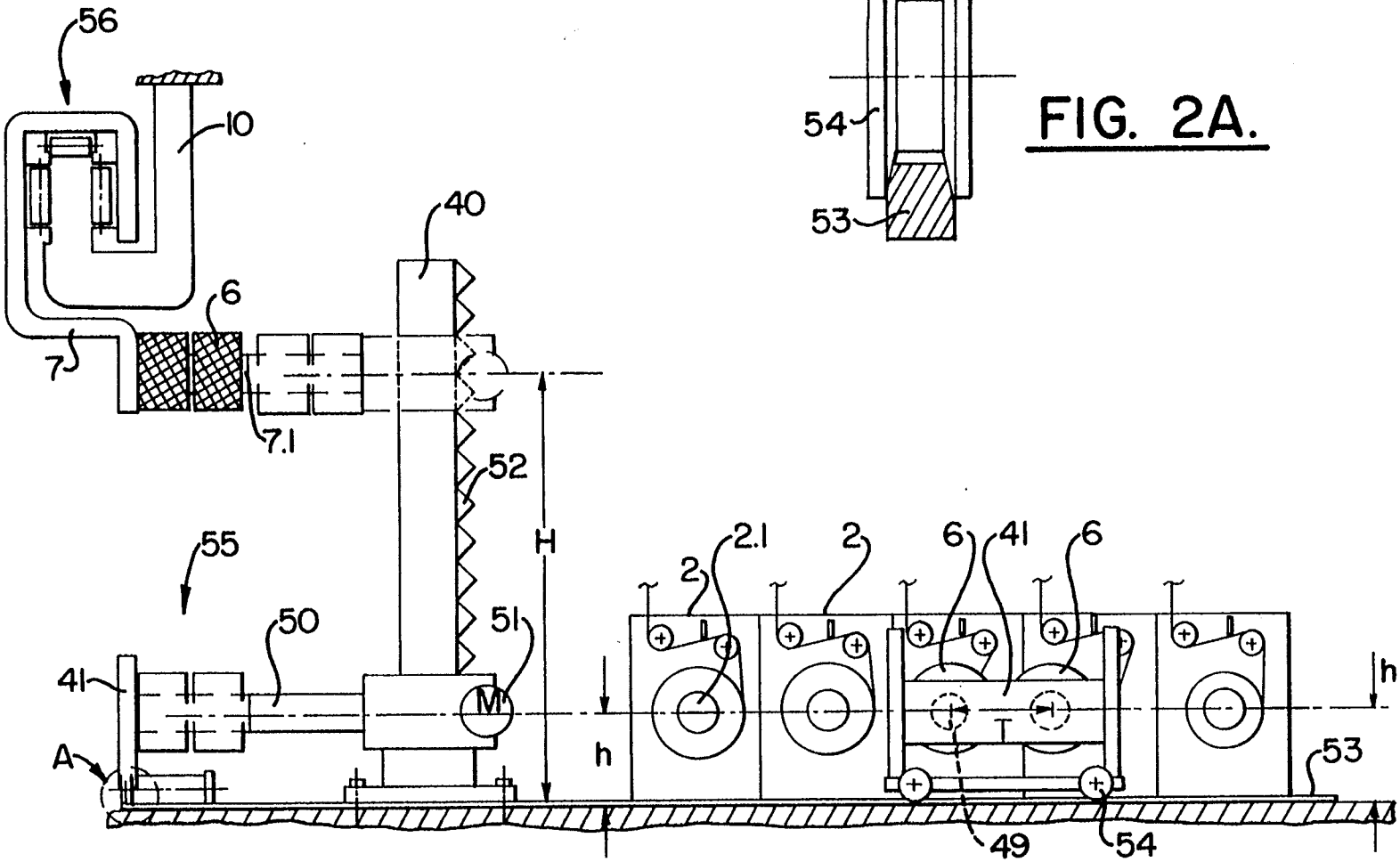
FIG. 2 is a detailed view of the additional service carriage of the present invention.

As is shown in FIG. 2, each transport carriage 7 receives the full packages produced on a spindle by means of mandrel 7.1 in such a manner that the mandrels are loaded at the height H above the height h of the winding spindles.

In addition to the doffer 5, which is not seen in FIG. 2, the independent service carriage 41, also described as emergency service carriage, travels along the winding machine front. This independent service carriage is provided with rigid package mandrels 49 which project in this illustration into the plane of the drawing, and face the winding spindles with their free ends. The package mandrels 49 are at the same height h as the winding spindles, and pass with their tips by the free ends of the winding spindles in a close proximity thereto when the independent service carriage is moved along a rail 53.

At the left end of the service aisle as seen in FIG. 2, the stationary emergency elevator 40 is arranged, and the elevator 40 includes at least one lifting mandrel 50 for receiving the full packages. Preferably, the emergency elevator is provided with a paired number of such lifting mandrels 50, which are arranged in like manner as the paired package mandrels 49 of the independent service carriage. In the illustrated embodiment, they are spaced from one another at the distance T, which is also described as transport gauge. However, this is only a useful embodiment of the invention and by no means a condition.

The emergency elevator 40 is provided with a drive motor 51 and a linear drive 52 which is a rack constantly engaging with a drive pinion which is mounted on the motor shaft (not shown).

These two drive components 51, 52 cause the lifting mandrel or mandrels 50 to move upward in the loaded condition between heights h and H, and downward in the unloaded condition, or while carrying empty tubes, if need be.

A characteristic of the emergency service carriage 41 is that it does not have its own drive, and it is moved forward and backward manually along rail 53, and respectively brought to that winding machine whose full packages need to be doffed.

Likewise, the rail 53 is a desirable feature of the invention but it is by no means a necessary component. As illustrated, the rail 53 extends first parallel to the row of winding machines and then it reverses at its left end by 90° into the plane of the drawing. The emergency service carriage 41 is guided in the rail by wheels 54 on one of its longitudinal sides, and must consequently follow the curvature of rail 53.

The distance between the rail 53 and the emergency elevator 40 is selected such that in the transfer position 55 shown in dashed lines from the emergency service carriage 41 to the emergency elevator, the package mandrels 49 of the emergency service carriage and the lifting mandrels 50 of the emergency elevator directly face one another with a minimum clearance, thus permitting the full packages to be shifted from the emergency service carriage 41 to the emergency elevator 40 in a simple manner.

The process of handling full packages in the fully automatic operation of the doffers 5 will now be described.

In the illustrated embodiment, four packages are simultaneously produced on each of the winding spindles. Each doffer 5 is provided with two parallel doffing mandrels 42 which are spaced from one another by the distance of the transport gauge T, and designed to receive half the number of the packages which are simultaneously produced on a winding spindle. Thus, in the illustrated embodiment, each of the mandrels 42 receives two packages 6. This operation is described in detail, for example, in DE-OS 29 39 675, to which reference may be made for a further disclosure.

When a winding machine 2 requests the doffing of packages, the associated doffer 5 travels to the corresponding winding machine 2.1, 2.2, 2.3, 2.4, and calls for a free transport carriage 7.

Each transport carriage 7 has two transport mandrels 7.1 which are likewise spaced from one another by the distance T of the transport gauge. The called transport carriage 7 positions itself in the associated doffer position, so that the transport mandrels 7.1 of the carriage 7 are exactly coaxial with the mandrels 42 of the doffer still facing the row of winding machines.

The doffer receives on each of its two mandrels 42 respectively half of the full packages of a winding spindle, which is two, and then swings its mandrels by 180°, so that the doffer arms carrying the full packages are associated to and exactly aligned with the transport mandrels 7.1 of the waiting carriage 7. The rotation is effected about the vertical axis 48.

The doffer 5 now pushes the two packages from each of its mandrels 42 onto the transport mandrels 7.1 of the carriage 7, which are likewise designed to receive two full packages.

The newly loaded transport carriage 7 now moves with its load on the forward track segment 30 of its conveying track 10.1, 10.2 up to the end 32 of one of the storage aisles 13, each of which is invariably associated to one of the service aisles 4.1, 4.2. There, the mandrels 7.1 of transport carriage 7 are directed into the storage aisle, with the transport carriage stopping in a position in which its mandrels can be brought into alignment with the mandrels 18 on elevator 17 of the servicing device 15. The elevator 17 on servicing device 15 then moves its mandrels 18 which are likewise spaced from one another by transport gauge T, to transport height I, II at which the transport carriage has arrived. Subsequently, the servicing device 15 moves along aisle 13 toward the transport carriage, until the mandrels 18 of servicing device 15 are aligned with the mandrels 7.1 of transport carriage 7, and so that each of the mandrels 18 receives two full packages.

The unloaded transport carriage 7 travels now on return track segment 31 past the empty tube magazine 33.1 or 33.2, loads there the number of empty tubes required for a winding spindle, and is temporarily moved to a standby position on the portion of the return track segment 31 forming the cul-de-sac 34, until a doffer requests empty tubes.

The loaded servicing device 15 now travels in a direction toward the other end 21 of storage aisle 13, with the elevator 17 being moved to a height in which two juxtaposed mandrels of the high-rise creel are unoccupied. Subsequently, a rotation by 90° occurs, so that the mandrels 18 of servicing device 15 are in alignment with the free mandrels of the high-rise creel. The full packages are then delivered to the high-rise creel and temporarily stored.

The above functions repeat themselves continuously during a full twenty-four hour day.

Unless the control station 8 for the individual packages and the packing station are occupied, the individual conveyor platforms 20 are moved in position at one end 21 of storage aisle 13. Each of the individual conveyor platforms 10 possesses only one transport mandrel, however the dimensions of the conveyor platforms are selected such that the two mandrels of two closely adjoining individual conveyor platforms are likewise spaced from one another by the distance of transport gauge T.

In this position, the mandrels 18 of servicing devices 15 can be brought in alignment with the mandrels 26 of the two conveyor platforms 20.

To this end, the servicing device 15 removes from two adjacent storage mandrels 14 of one level respectively one full package, rotates by 90° in the direction of the individual conveyor platforms, and moves the mandrels 18 to a height which is identical with the height of the mandrels 26 of individual conveyor platforms 20. Thereafter, the two individual conveyor platforms 20 are started up from their stopped position and loaded at the same time, so that they can leave for the control station 8 and the packing station 9.

In the event of a doffer failure, however, the full packages are manually handled as follows:

When a doffer fails, the emergency elevator 40 is loaded with full packages by hand. To this end, the service carriage 41 initially receives the full packages. More particularly, after the service carriage 41 has been brought to its loading position in front of one of the winding spindles 2.1, the first half of existing full packages 6 is pushed from winding spindle 2.1 onto one of the rigid carriage mandrels 49 which are provided in pairs on the service carriage 41, and subsequently the service carriage is moved relative to the winding spindle by transport gauge T. Then, the second half of the full packages is pushed onto the second of the paired carriage mandrels of the service carriage, and the process of package transfer from the winding spindle to the service carriage is completed.

Since in the present embodiment, the service carriage 41 is provided with a pair of carriage mandrels 49, which receive each half the number of packages from a single winding spindle, and which are spaced at the transport gauge, it is possible to complete the transfer process of the produced packages from the service carriage to the emergency elevator in a single step.

After the service carriage 41 has been moved to its transfer position 55 adjacent the emergency elevator, all packages are simultaneously pushed from the pair of carriage mandrels 49 of the service carriage onto the lifting mandrels 50 arranged in pairs on the emergency elevator 40, and the service carriage 41 is thus ready to service the next winding machine.

The next step is to move the transferred full packages from the lifting mandrels 50 to the mandrels 7.1 of a transport carriage 7. To this end, a transport carriage 7 is positioned at the loading position 56 of emergency elevator 40. The mandrels 50 of the emergency elevator loaded with the full packages 6 are moved vertically upward to the height H so that they are aligned with the mandrels 7.1 of the transport carriage 7 positioned at the loading position 56. Subsequently, the full packages are moved from the mandrels 50 of the emergency elevator 40 to the mandrels 7.1 of the transport carriage 7. The unloaded mandrels 50 of the emergency elevator now move downward, so as to be ready for the next loading cycle.

It is preferred to position the emergency elevator 40 at the end of the second branch 37 of the forward track segment 30, which is at the end of the service aisle adjacent the storage 11, since this simple measure permits the transport carriages 7 to continue their operation unimpeded, when one the transport carriages is loaded.

In addition, it may be provided that the emergency elevator 40 receives empty tubes from the positioned transport carriage 7 and moves them downward for removal and mounting on a winding spindle.

In the drawings and specification, there has been set forth a preferred embodiment of the invention, and although specific terms are employed, they are used in a generic and descriptive sense only and not for purposes of limitation.

That which is claimed is:

1. A textile yarn processing apparatus for the continuous production of synthetic filament yarns comprising package winding means comprising a plurality of yarn winding machines arranged in parallel rows to define a service aisle therebetween, with each of said winding machines having at least one winding spindle positioned at a predetermined first elevation and which is adapted to have at least one yarn package wound thereon, doffer means adapted to move along said service aisle of said winding machines for receiving full packages from said winding spindles at said first elevation and lifting the same to a predetermined second elevation, transport carriage means movable along a path of travel which includes said service aisle and including at least one transport mandrel positioned at said second elevation, and such that said transport mandrel is adapted to receive full packages from said doffer means at said second elevation, an independent service carriage configured for movement along said service aisle and having at least one carriage mandrel mounted at said first elevation and so as to be adapted to receive full packages from each of said winding spindles at said first elevation, and elevator means including a lifting mandrel mounted for vertical movement between said first and second elevations, and with said elevator means being located at a fixed location adjacent said path of travel of said transport carriage means, such that said service carriage may be used to transport full packages from said winding spindles of said winding machines to said lifting mandrel at said first elevation and the full packages may then be lifted to said second elevation and transferred to said transport mandrel of said transport carriage means.

2. The textile yarn processing apparatus as defined in claim 1 further comprising a guide rail extending along said service aisle, and said independent service carriage includes guide wheel means for engaging said guide rail so that said carriage is guided for movement along said rail.

3. The textile yarn processing apparatus as defined in claim 2 wherein said independent service carriage is characterized by the absence of drive means and so that it is manually movable along said rail.

4. The textile yarn processing apparatus as defined in claim 1 further comprising magazine means positioned along said path of travel of said transport carriage means for supporting a plurality of empty winding tubes in vertically stacked, horizontal rows of tubes, and whereby empty tubes are adapted to be transported from said magazine means onto said transport mandrel of said transport carriage means, and said elevator means is adapted to receive empty winding tubes from said transport carriage means and so that the winding tubes may be transferred to said independent service carriage.

5. The textile yarn processing apparatus as defined in claim 1 further comprising an overhead conveyor track mounting said transport carriage means for movement along said path of travel.

6. The textile yarn processing apparatus as defined in claim 1 wherein said doffer means comprises a pair of doffing mandrels, and wherein a pair of said transport mandrels are mounted to said transport carriage means, a pair of said carriage mandrels are mounted to said service carriage, and a pair of said lifting mandrels are mounted to said elevator means, and wherein all of said pairs are horizontally spaced apart a uniform distance.

7. The textile yarn processing apparatus as defined in claim 1 further comprising package storage means comprising a plurality of creels of substantial height and which are arranged parallel to each other to define at least one storage aisle therebetween, and with each creel having a plurality of storage mandrels arranged side by side in vertically spaced apart horizontal rows, and with the mandrels projecting toward the associated storage aisle, and servicing means movable along each storage aisle for delivering full packages to selected mandrels of a selected creel and for removing the same from such creels, and package processing means comprising a receiving area positioned adjacent one of the ends of each storage aisle of said storage means, a processing station spaced from said receiving area, and conveyor means for receiving full packages from said servicing means of said storage means at said receiving area of said processing means and conveying the same to said processing station.

8. The textile processing apparatus as defined in claim 7 wherein said transport carriage means includes a conveyor track extending along said path of travel, and wherein said conveyor track comprises a closed loop which includes a forward track segment leading from said package winding means to said storage means and a return track segment leading from said storage means to said package winding means.

9. The textile processing apparatus as defined in claim 8 wherein said service aisle includes a first end proximate said storage means and a second end remote from said storage means, and wherein said return track segment of said conveyor track extends as a cul-de-sac along said service aisle and which terminates adjacent said second end of said service aisle, and said forward track segment of said conveyor track includes a U-shaped portion along said service aisle and which terminates adjacent said first end of said service aisle.

10. The textile processing means as defined in claim 9 wherein said elevator means is located adjacent said first end of said service aisle.

11. A textile yarn processing apparatus for the continuous production of synthetic filament yarns comprising package winding means comprising a plurality of yarn winding machines arranged in parallel rows to define a service aisle therebetween, with each of said winding machines having at least one winding spindle which extends perpendicularly toward said service aisle at a predetermined first elevation and which is adapted to have at least one yarn package wound thereon, doffer means adapted to move along said service aisle of said winding machines, and including a pair of doffing mandrels, and means for vertically moving said doffing mandrels between said first elevation and a predetermined second elevation, and for rotating said doffing mandrels between a first position facing said winding spindles of one of said rows of winding machines and a second position facing away from said winding spindles of said one row of winding machines, transport carriage means movable along a path of travel which includes said service aisle and including a pair of transport mandrels positioned at said second elevation, and such that said transport mandrels are adapted to receive full packages from respective ones of said doffing mandrels at said second elevation, an independent service carriage configured for movement along said service aisle and having a pair of carriage mandrels mounted at said first elevation and so as to be adapted to receive full packages from said winding spindles at said first elevation, and elevator means including a pair of lifting mandrels mounted for vertical movement between said first and second elevations, and with said elevator means being located at a fixed location adjacent said path of travel of said transport carriage means, such that said service carriage may be used to transport full packages from said winding spindles of said winding machines to said lifting mandrels at said first elevation and the full packages may then be lifted to said second elevation and transferred to said transport mandrels of said carriage means.

12. The textile yarn processing apparatus as defined in claim 11 wherein said pair of doffing mandrels, said pair of transport mandrels, said pair of carriage mandrels, and said pair of lifting mandrels are all horizontally spaced apart a uniform distance.

13. The textile yarn processing apparatus as defined in claim 12 further comprising a guide rail extending along said service aisle, and said independent service carriage includes guide wheel means for engaging said guide rail so that said carriage is guided for movement along said rail, and wherein said elevator means is positioned adjacent said guide rail such that said service carriage may be moved to a loading position wherein said pair of carriage mandrels are coaxially aligned with and immediately adjacent respective ones of said lifting mandrels.

* * * * *